US011306613B2

(12) United States Patent
Kitamura et al.

(10) Patent No.: US 11,306,613 B2
(45) Date of Patent: Apr. 19, 2022

(54) TURBOCHARGER

(71) Applicant: MITSUBISHI HEAVY INDUSTRIES ENGINE & TURBOCHARGER, LTD., Sagamihara (JP)

(72) Inventors: Tsuyoshi Kitamura, Tokyo (JP); Seiichi Ibaraki, Tokyo (JP); Toyotaka Yoshida, Tokyo (JP); Hiroshi Suzuki, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 102 days.

(21) Appl. No.: 16/078,422

(22) PCT Filed: Mar. 7, 2016

(86) PCT No.: PCT/JP2016/056961
§ 371 (c)(1),
(2) Date: Aug. 21, 2018

(87) PCT Pub. No.: WO2017/154069
PCT Pub. Date: Sep. 14, 2017

(65) Prior Publication Data
US 2019/0063260 A1 Feb. 28, 2019

(51) Int. Cl.
*F01D 25/14* (2006.01)
*F02C 6/12* (2006.01)
(Continued)

(52) U.S. Cl.
CPC ..... *F01D 25/145* (2013.01); *F01D 25/162* (2013.01); *F02B 39/00* (2013.01);
(Continued)

(58) Field of Classification Search
CPC ..... F01D 25/145; F01D 25/243; F02C 7/24; F02C 6/12; F05D 2220/40
See application file for complete search history.

(56) References Cited

U.S. PATENT DOCUMENTS 3,263,424 A * 8/1966 Birmann ..... F01D 25/145 60/799
4,198,192 A * 4/1980 Webb ..... F01D 25/00 415/177
(Continued)

FOREIGN PATENT DOCUMENTS

DE 20 2005 009 491 U1 9/2005
DE 10 2011 114 060 A1 3/2013
(Continued)

OTHER PUBLICATIONS

International Search Report dated May 17, 2016 in PCT Application No. PCT/JP2016/056961 with an English Translation.
(Continued)

*Primary Examiner* — Justin D Seabe
(74) *Attorney, Agent, or Firm* — Birch, Stewart, Kolasch & Birch, LLP

(57) ABSTRACT

A turbocharger (10A) has a back plate (41). The back plate (41) is provided with a plate section (41*a*) and a flange section (41*c*) which is formed radially outside the plate section (41*a*) and which is supported so as to be sandwiched between a bearing housing (16) and a turbine housing (31). The turbocharger (10A) is further provided with a flange heat shielding section (53) provided between the flange section (41*c*) and the bearing housing (16) and consisting of a material having lower heat conductivity than the turbine housing (31) and the back plate (41).

1 Claim, 8 Drawing Sheets

(51) Int. Cl.
*F02B 39/00* (2006.01)
*F01D 25/16* (2006.01)

(52) U.S. Cl.
CPC ..... *F05D 2220/40* (2013.01); *F05D 2240/15* (2013.01); *F05D 2260/231* (2013.01); *F05D 2260/39* (2013.01); *F05D 2300/5024* (2013.01)

(56) References Cited

U.S. PATENT DOCUMENTS

| | | | | |
|---|---|---|---|---|
| 8,827,638 | B2 * | 9/2014 | Delitz | F02C 6/12 415/178 |
| 9,212,700 | B1 * | 12/2015 | Bucking | F16C 37/007 |
| 9,683,456 | B2 * | 6/2017 | Burmester | F02C 6/12 |
| 9,988,977 | B2 * | 6/2018 | Crandall | F01D 5/046 |
| 2006/0127244 | A1 | 6/2006 | Frankenstein et al. | |
| 2008/0304957 | A1 | 12/2008 | Walter et al. | |
| 2009/0060737 | A1 | 3/2009 | Frankenstein et al. | |
| 2011/0014036 | A1 | 1/2011 | Boening et al. | |
| 2015/0049967 | A1 * | 2/2015 | Fraser | F04D 29/0473 384/100 |
| 2015/0252689 | A1 | 9/2015 | Burmester et al. | |

FOREIGN PATENT DOCUMENTS

| | | | | |
|---|---|---|---|---|
| EP | 0 187 486 | A1 | 7/1986 | |
| EP | 1 672 177 | A1 | 6/2006 | |
| GB | 2 271 814 | A | 4/1994 | |
| JP | 58025630 | U * | 2/1983 | F01D 25/08 |
| JP | 59-32131 | U | 2/1984 | |
| JP | 62-145948 | U | 9/1987 | |
| JP | 4931917 | B2 | 2/2012 | |
| WO | WO 2007/104535 | A1 | 9/2007 | |
| WO | WO 2009/068460 | A1 | 6/2009 | |

OTHER PUBLICATIONS

Written Opinion dated May 17, 2016 in PCT Application No. PCT/JP2016/056961 with an English Translation.

* cited by examiner

TURBOCHARGER

TECHNICAL FIELD

The present invention relates to a turbocharger.

BACKGROUND ART

A turbocharger includes a turbocharger body, a compressor, and a turbine. The turbocharger body includes a rotating shaft and a bearing housing which rotatably supports the rotating shaft via a bearing. The rotating shaft includes a turbine wheel on a first end portion side and a compressor wheel on a second end portion side. The turbine wheel is accommodated in a turbine housing which is connected to the bearing housing. The compressor wheel is accommodated in a compressor housing which is connected to the bearing housing.

In the turbocharger, the turbine wheel is rotated by a flow of an exhaust gas supplied from an engine into the turbine housing. The compressor wheel provided in the compressor housing is rotated according to the rotation of the turbine wheel, and thus, air is compressed. The air compressed by the compressor is supplied to the engine.

During an operation of the turbocharger, a high-temperature exhaust gas flows to the turbine, and thus, a temperature of the turbine housing increases. If thermal energy of the turbine escapes to the bearing housing side, energy loss occurs in the turbine.

In order to prevent the bearing housing side from being damaged by heat input from the turbine side, it is preferable to suppress a heat input from the turbine side to the bearing housing side.

PTL discloses a configuration in which a heat insulating material and a gap functioning as a heat insulating layer are provided between a turbine wheel and a bearing of a bearing housing in order to suppress a heat input from a turbine to a bearing housing.

CITATION LIST

Patent Literature

[PTL 1] Japanese Patent No. 4931319

SUMMARY OF INVENTION

Technical Problem

In the above-described turbocharger, it is desired to further suppress energy loss in the turbine and the heat input from the turbine to the bearing.

An object of the present invention is to provide a turbocharger capable of suppressing the energy loss in the turbine and the heat input from the turbine to the bearing.

Solution to Problem

According to a first aspect of the present invention, there is provided a turbocharger including: a rotating shaft which extends along an axis; a turbine wheel which is provided on a first end portion side of the rotating shaft; and a compressor wheel which is provided on a second end portion side of the rotating shaft. The turbocharger further includes a bearing housing which rotatably supports the rotating shaft and a turbine housing which covers the turbine wheel. The turbocharger further includes a back plate which includes a plate portion which is provided between the bearing housing and the turbine wheel and an outer peripheral end portion which is formed radially outside the plate portion and is supported to be interposed between the bearing housing and the turbine housing. The turbocharger further includes a plate outer peripheral heat shielding portion which is provided between the outer peripheral end portion of the back plate and the bearing housing and is formed of a material having thermal conductivity lower than those of the turbine housing and the back plate.

In this way, the plate outer peripheral heat shielding portion is provided between the outer peripheral end portion of the back plate and the bearing housing, and thus, it is possible to inhibit heat of a heated back plate from being transmitted from the outer peripheral end portion of the back plate to the bearing housing.

According to a second aspect of the present invention, in the first aspect, the turbocharger may further include a spacer which is interposed between the bearing housing and the turbine housing, in which the spacer may include a heat shielding portion holder which is formed to hold a plurality of the plate outer peripheral heat shielding portions at intervals in a circumferential direction.

According to this configuration, in a case where the spacer is provided between the bearing housing and the turbine housing, it is possible to provide the plate outer peripheral heat shielding portion between the bearing housing and the turbine housing. Accordingly, it is possible to inhibit heat from being transmitted from the outer peripheral end portion of the back plate to the bearing housing.

According to a third aspect of the present invention, in the second aspect, in the turbocharger, a plurality of openings may be formed on the outer peripheral end portion of the back plate at intervals in a circumferential direction.

In this way, the openings are formed on the back plate which is positioned on the turbine housing side with respect to the plate outer peripheral heat shielding portion, and thus, the plate outer peripheral heat shielding portion faces the openings. The thermal conductivity of an inner space in each opening is lower than the thermal conductivity of the back plate, and thus, heat shielding effects can be obtained by the inner space of the opening.

According to a fourth aspect of the present invention, there is provided a turbocharger including: a rotating shaft which extends along an axis; a turbine wheel which is provided on a first end portion side of the rotating shaft; and a compressor wheel which is provided on a second end portion side of the rotating shaft. The turbocharger further includes a bearing housing which rotatably supports the rotating shaft and a turbine housing which covers the turbine wheel. The turbocharger further includes a back plate which includes a plate portion which is provided between the bearing housing and the turbine wheel and an outer peripheral end portion which is formed radially outside the plate portion and is supported to be interposed between the bearing housing and the turbine housing. The turbocharger further includes a turbine-side heat shielding portion which is disposed between the back plate and the turbine wheel and covers the plate portion of the back plate.

In this way, the turbine-side heat shielding portion is provided between the back plate and the turbine wheel, and thus, it is possible to inhibit a temperature of the back plate from increasing due to heat on the turbine side. Accordingly, it is possible to inhibit heat from being transmitted from the turbine housing side to the bearing housing via the back plate.

According to a fifth aspect of the present invention, in the fourth aspect, the turbocharger may further include a partition member which partitions the turbine-side heat shielding portion from the turbine wheel on the turbine wheel side with respect to the turbine-side heat shielding portion.

According to this configuration, it is possible to inhibit heat from being transmitted from the turbine wheel side to the turbine-side heat shielding portion by the partition member.

Advantageous Effects of Invention

According to the turbocharger, it is possible to suppress the energy loss in the turbine and the heat input from the turbine to the bearing.

DESCRIPTION OF EMBODIMENTS

Hereinafter, a turbocharger according to embodiments of the present invention will be described with reference to the drawings.

First Embodiment

Figure 1:
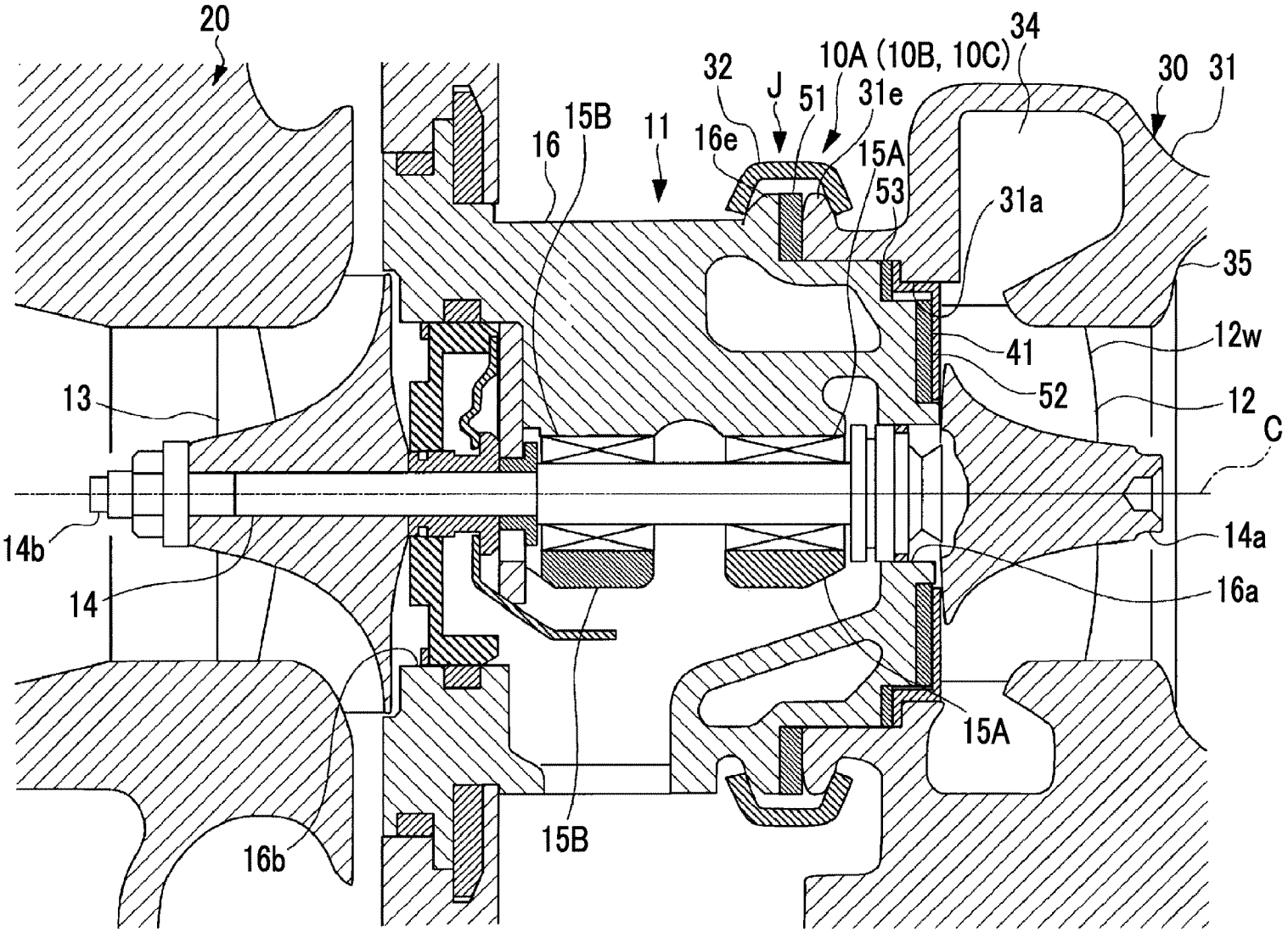
FIG. 1 is a cross-sectional view showing an overall configuration of a turbocharger in an embodiment of the present invention.

FIG. 1 is a cross-sectional view showing an overall configuration of a turbocharger according to an embodiment of the present invention.

As shown in FIG. 1, a turbocharger 10A of the present embodiment includes a turbocharger body 11, a compressor 20, and a turbine 30. For example, the turbocharger 10A is mounted as an auxiliary machine of an engine on an automobile or the like in a state where a rotating shaft 14 extends in a horizontal direction. The turbocharger 10A is supported by a vehicle body or the like via a bracket (not shown), the compressor 20, the turbine 30, or the like.

The turbocharger body 11 includes the rotating shaft 14, a bearing 15A, and a bearing housing 16.

The rotating shaft 14 is rotatably supported by the bearing 15A accommodated in the bearing housing 16. A turbine wheel 12 is integrally formed on a first end portion 14*a* of the rotating shaft 14, and a compressor wheel 13 is attached to a second end portion 14*b* of the rotating shaft 14.

The bearing housing 16 is formed to accommodate the bearing 15A and to cover the rotating shaft 14 from the outside. The bearing housing 16 includes an opening 16*a* on a first end portion side of the bearing housing 16 and an opening 16*b* on a second end portion side thereof. The first end portion 14*a* and the second end portion 14*b* of the above-described rotating shaft 14 protrude toward the outside of the bearing housing 16 through the openings 16*a* and 16*b*, respectively. That is, each of the above-described turbine wheel 12 and the compressor wheel 13 is disposed outside the bearing housing 16.

The compressor 20 includes the compressor wheel 13 and a compressor housing 21. The compressor 20 is a so-called a centrifugal compressor and boosts air such as outside air. The boosted air is supplied to the engine.

The compressor wheel 13 is rotated together with the rotating shaft 14. The compressor wheel is rotated, air flowing from an inlet of the compressor housing 21 is moved radially outward while being compressed and is discharged to the outside of the compressor housing 21 via a scroll or the like.

The turbine 30 recovers energy of an exhaust gas discharged from an engine (not shown). The turbine 30 mainly includes the turbine wheel 12 and a turbine housing 31.

The turbine wheel 12 converts energy of the exhaust gas into rotational energy. The turbine wheel 12 is accommodated in the turbine housing 31 and includes a plurality of turbine blades 12*w* in a circumferential direction. The turbine wheel 12 is rotated by the exhaust gas supplied to the inside of the turbine housing 31. The rotation of the turbine wheel 12 is transmitted to the compressor wheel 13 via the rotating shaft 14.

The turbine housing 31 has an opening 31*a* at a position facing the bearing housing 16. An accommodation space for accommodating the turbine wheel 12 is formed inside the turbine housing 31. The turbine housing 31 includes a gas introduction portion (not shown), a scroll flow path 34, and an exhaust section 35.

The gas introduction portion (not shown) feeds the exhaust gas discharged from the engine (not shown) to the scroll flow path 34.

The scroll flow path 34 is continuous to the gas introduction portion (not shown) and is continuously formed in the circumferential direction to surround an outer peripheral side of the turbine wheel 12. At least a portion of the scroll flow path 34 in the circumferential direction is provided to face an outer peripheral portion of the turbine wheel 12, and thus, a flow path through which the exhaust gas rotating the turbine wheel 12 flows in the circumferential direction is formed.

The exhaust gas discharged from the turbine wheel 12 flows to the exhaust section 35. The exhaust section 35 is continuously formed in a direction separated from the turbocharger body 11 in a direction of a central axis C of the rotating shaft 14 from an outer peripheral portion of the turbine wheel 12.

In the turbine 30, the exhaust gas which has flowed from the gas introduction portion (not shown) flows to the outer peripheral side of the turbine wheel 12 in the circumferential direction along the scroll flow path 34. In this way, the exhaust gas flowing in the circumferential direction strikes the turbine blade 12*w* of the turbine wheel 12, and thus, the turbine wheel 12 is rotated. The exhaust gas which has passed through the turbine wheel 12 is discharged from the inner peripheral side of the turbine wheel 12 to the exhaust section 35.

An end portion 31*e* on the bearing housing 16 side in an outer peripheral portion of the turbine housing 31 and an end portion 16*e* in an outer peripheral portion of the bearing housing 16 are connected to each other via a connection fitting 32 in a joint portion J.

Figure 2:
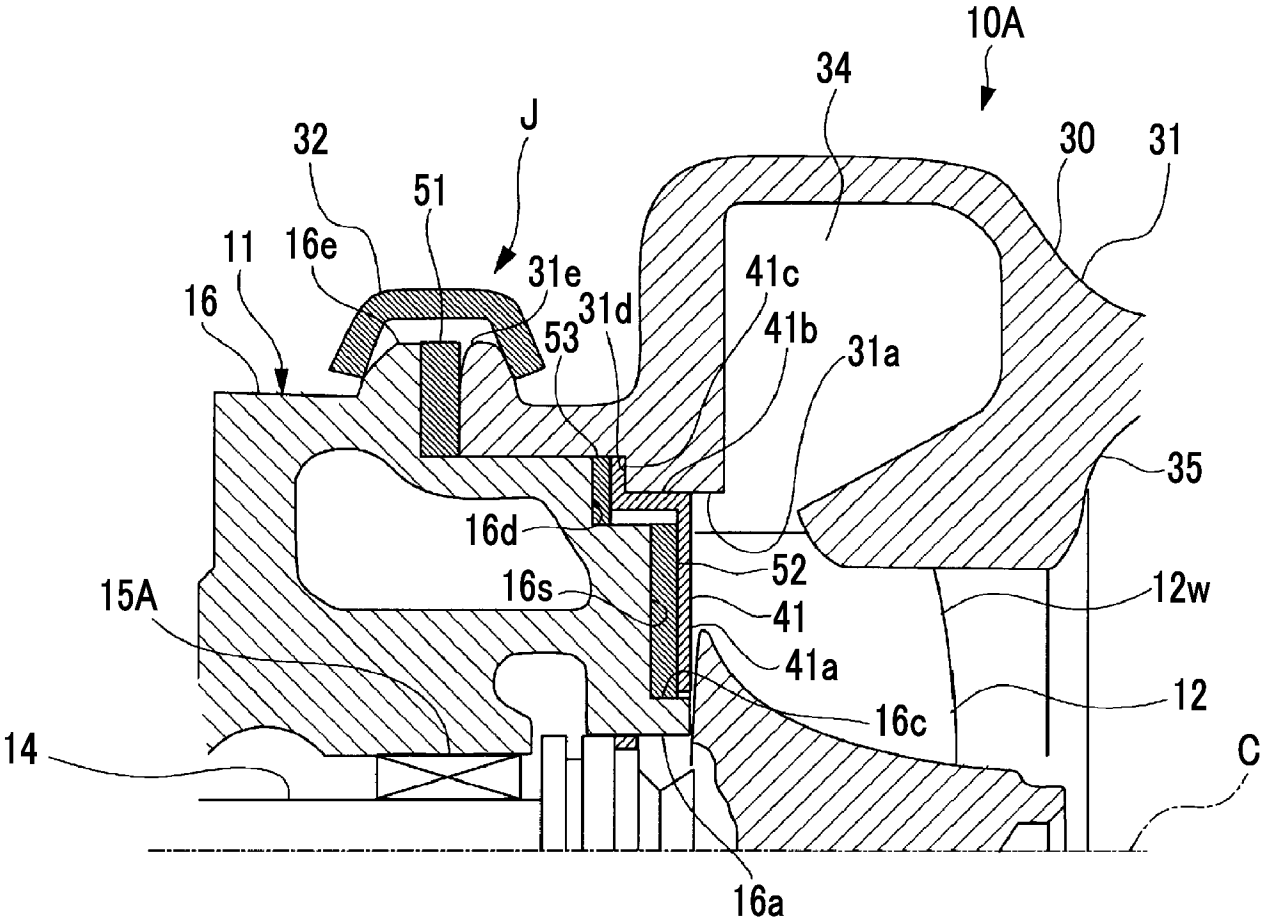
FIG. 2 is an enlarged cross-sectional view showing a configuration in the vicinity of a joint portion between a turbine housing and a bearing housing in a turbocharger in a first embodiment of the present invention.

FIG. 2 is an enlarged cross-sectional view showing a configuration in the vicinity of a joint portion between a turbine housing and a bearing housing in a first embodiment of the present invention.

As shown in FIG. 2, in the joint portion J, a joint-portion heat shielding portion 51 is provided between the end portion 31*e* of the turbine housing 31 and the end portion 16*e* of the bearing housing 16.

The joint-portion heat shielding portion 51 is formed of a material having thermal conductivity lower than that of the turbine housing 31. For example, the joint-portion heat shielding portion 51 can be formed of a heat insulating material or a heat shielding material having the thermal conductivity of 0.1 W/m/K or less at the room temperature. For example, the joint-portion heat shielding portion 51 can be formed of a porous body or sheet material made of a ceramic material, a silica material, or the like. In the joint-portion heat shielding portion 51, a coating may be applied to at least one of the end portion 31*e* of the turbine housing 31 and the end portion 16*e* of the bearing housing 16 facing each other with the heat shielding material having the thermal conductivity.

Here, the joint-portion heat shielding portion 51 has strength to maintain a predetermined thickness in a state of being interposed between the end portion 31*e* of the turbine housing 31 and the end portion 16*e* of the bearing housing 16.

In the opening 31*a* of the turbine housing 31, a back plate 41 is provided on the bearing housing 16 side with respect to the turbine wheel 12. The back plate 41 integrally includes a plate portion 41*a*, a tubular portion 41*b*, and a flange portion (outer peripheral-side end portion) 41*c*.

The plate portion 41*a* closes a portion between an outer peripheral surface of a boss section 16*c* protruding toward the turbine 30 side on one end side of the bearing housing 16 and the opening 31*a*.

The tubular portion 41*b* is formed in a tubular shape to extend from an outer peripheral portion of the plate portion 41*a* to the bearing housing 16 side along an inner peripheral surface of the opening 31*a*.

The flange portion 41*c* is formed to extend radially outward from an end portion of the tubular portion 41*b* on the bearing housing 16 side. The flange portion 41*c* is interposed between a step section 31*d* which is formed on an inner peripheral surface of the turbine housing 31 and protrudes radially inward and an end surface 16*d* which faces the step section 31*d* with a gap in the bearing housing 16.

For example, the back plate 41 is formed of a material having heat resistance such as a stainless steel alloy or Inconel.

An inner peripheral heat shielding portion 52 is provided between the plate portion 41*a* of the back plate 41 and an end surface 16*s* of the bearing housing 16 which faces the plate portion 41*a* with a gap.

A plate outer peripheral heat shielding portion 53 is provided between the flange portion 41*c* of the back plate 41 and an end surface 16*d* of the bearing housing 16 which faces the flange portion 41*c*.

The inner peripheral heat shielding portion 52 and the plate outer peripheral heat shielding portion 53 are formed of a material having thermal conductivity lower than those of the turbine housing 31 and the back plate 41. For example, preferably, the inner peripheral heat shielding portion 52 and the plate outer peripheral heat shielding portion 53 are formed of a heat insulating material or a heat shielding material having the thermal conductivity of 0.1 W/m/K or less at the room temperature. For example, as the heat insulating material or the heat shielding material, a porous body, a sheet material, or the like made of a ceramic material, a silica material, or the like can be used. In the inner peripheral heat shielding portion 52 and the plate outer peripheral heat shielding portion 53, coating may be applied to the end surfaces 16*s* and 16*f* of the bearing housing 16 with the heat shielding material having the thermal conductivity. Moreover, the inner peripheral heat shielding portion 52 and the plate outer peripheral heat shielding portion 53 are not required to have strength. Accordingly, for example, fibers made of a heat insulating material or a heat shielding material may be used to be formed in a sponge shape as glass wool as long as it has required heat resistance. In addition, the inner peripheral heat shielding portion 52 and the plate outer peripheral heat shielding portion 53 may be formed such that only portions between the plate portion 41*a* and the flange portion 41*c* of the back plate 41 and the end surfaces 16*s* and 16*f* of the bearing housing 16 are filled with air.

Therefore, according to the turbocharger 10A of the above-described first embodiment, the plate outer peripheral heat shielding portion 53 is provided between the flange portion 41*c* of the back plate 41 and the bearing housing 16, and thus, it is possible to inhibit heat from being transmitted from the flange portion 41*c* of the back plate 41 to the bearing housing 16.

In addition, in the joint portion J between the turbine housing 31 and the bearing housing 16, the joint-portion heat shielding portion 51 formed of a material having the thermal conductivity lower than those of the turbine housing 31 and the bearing housing 16 is interposed, and thus, it is possible to inhibit heat in the turbine housing 31 from being transmitted to the bearing housing 16 via the turbine housing 31.

In addition, the inner peripheral heat shielding portion 52 is further provided between the plate portion 41*a* of the back plate 41 and the bearing housing 16, and thus, it is possible to inhibit heat from being transmitted from the plate portion 41*a* to the bearing housing 16.

In this way, according to the turbocharger 10A, it is possible to suppress energy loss in the turbine 30 and a heat input from the turbine 30 to the bearing housing 16.

Modification Example of First Embodiment

In the above-described embodiment, the plate outer peripheral heat shielding portion 53 is provided between the flange portion 41*c* of the back plate 41 and the end surface 16*d* of the bearing housing 16. However, the following configuration may be adopted.

Figure 3:
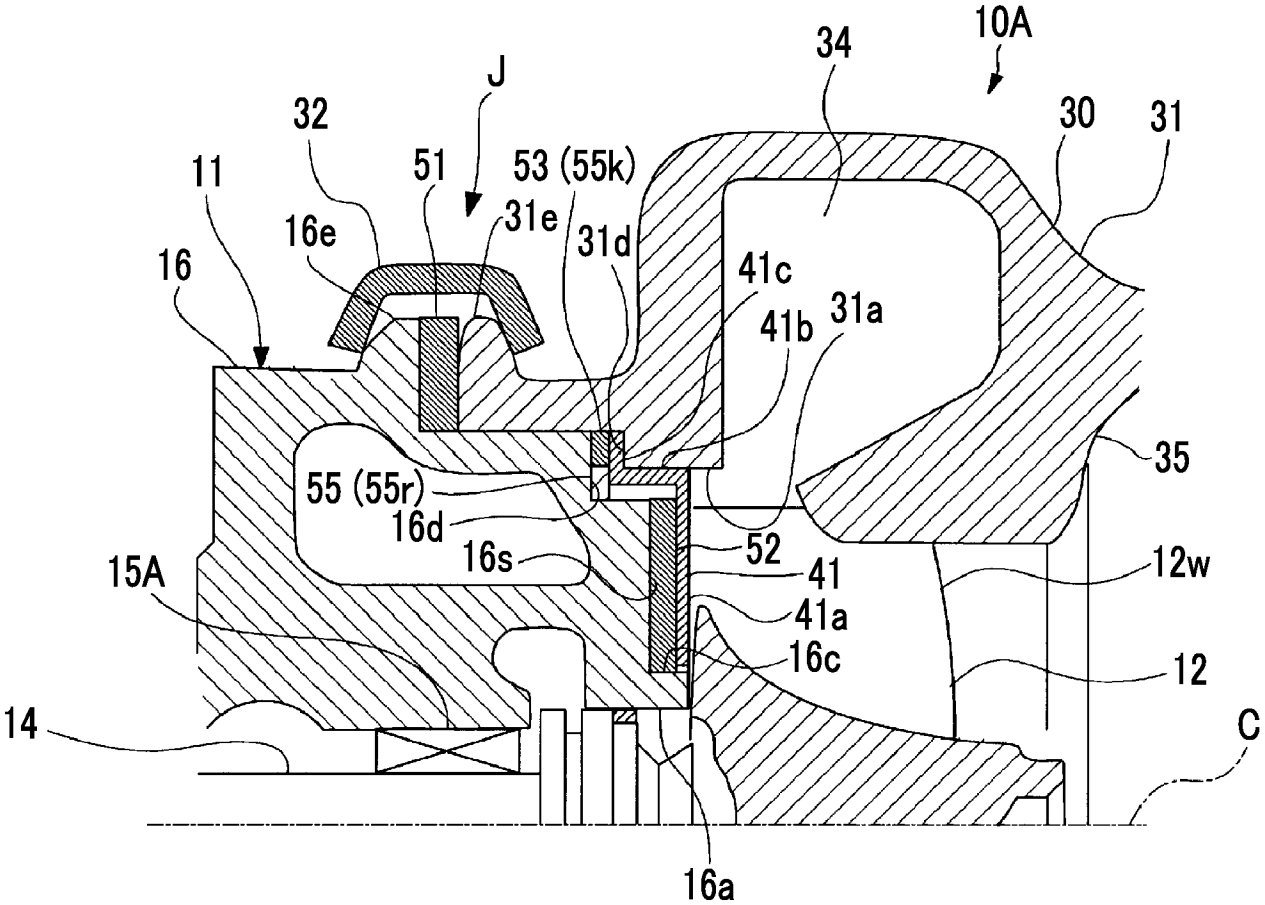
FIG. 3 is an enlarged cross-sectional view showing a configuration in the vicinity of a joint portion between a turbine housing and a bearing housing in a modification example of the first embodiment of the present invention.

FIG. 3 is an enlarged cross-sectional view showing a configuration in the vicinity of a joint portion between a turbine housing and a bearing housing in a modification example of the first embodiment of the present invention.

Figure 4:
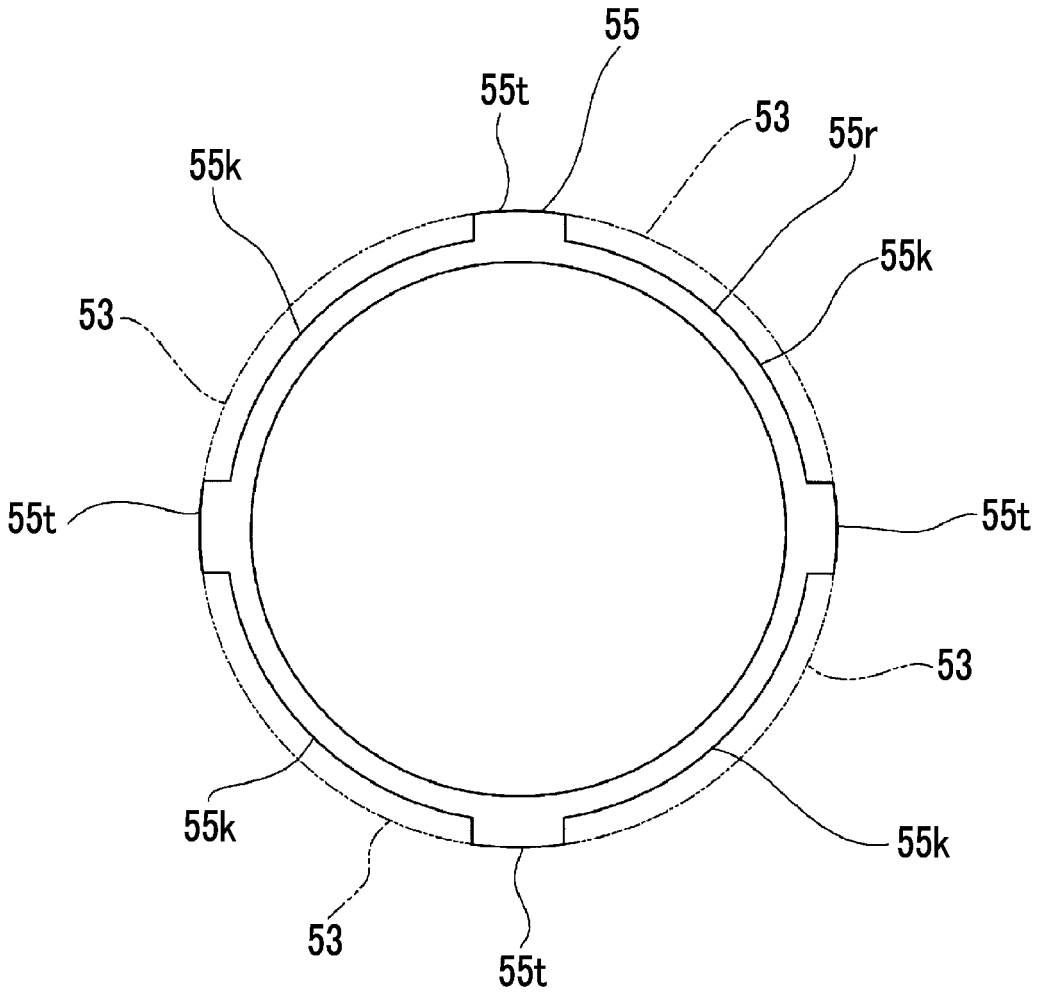
FIG. 4 is a view showing an example of a shape of a spacer in the modification example of the first embodiment of the present invention.

FIG. 4 is a view showing an example of a shape of a spacer in the modification example of the first embodiment of the present invention.

As shown in FIG. 3, a spacer 55 may be provided between the flange portion 41*c* and the end surface 16*s* of the bearing housing 16.

As shown in FIG. 4, the spacer 55 integrally includes an annular portion 55*r* and protrusion portions 55*t*. A plurality of protrusion portions 55*t* are formed on an outer peripheral side of the annular portion 55*r* at intervals in a circumferential direction. Each of the protrusion portions 55*t* is formed to extend radially outward from the annular portion 55*r*. Accordingly, in the spacer 55, cut-out portions (heat shielding portion holders) 55*k* are formed between the protrusion portions 55*t* and 55*t* which are adjacent to each other in the circumferential direction on a radially outside of the annular portion 55*r*.

The plate outer peripheral heat shielding portion 53 is provided so as to fill the cut-out portions 55*k*.

In this way, in the case where the spacer 55 is provided between the bearing housing 16 and the turbine housing 31, it is possible to provide the plate outer peripheral heat shielding portion 53 between the bearing housing 16 and the turbine housing 31. Accordingly, it is possible to inhibit heat from being transmitted from the flange portion 41*c* of the back plate 41 to the bearing housing 16, and it is possible to suppress energy loss in the turbine 30 and a heat input from the turbine 30 to the bearing housing 16.

In the first embodiment, the plate outer peripheral heat shielding portion 53 and the inner peripheral heat shielding portion 52 are not indispensable configurations, and may be changed to other configurations, or these configurations may not be provided.

Second Embodiment

Next, a second embodiment of the present invention will be described. In the second embodiment, only the configuration of the back plate is different from that of the first embodiment, and the configuration of the entire turbocharger is the same as that of the first embodiment. Accordingly, in the second embodiment, the same reference numerals are assigned to the same portions as those of the first embodiment, and overlapping descriptions thereof are omitted.

Figure 5:
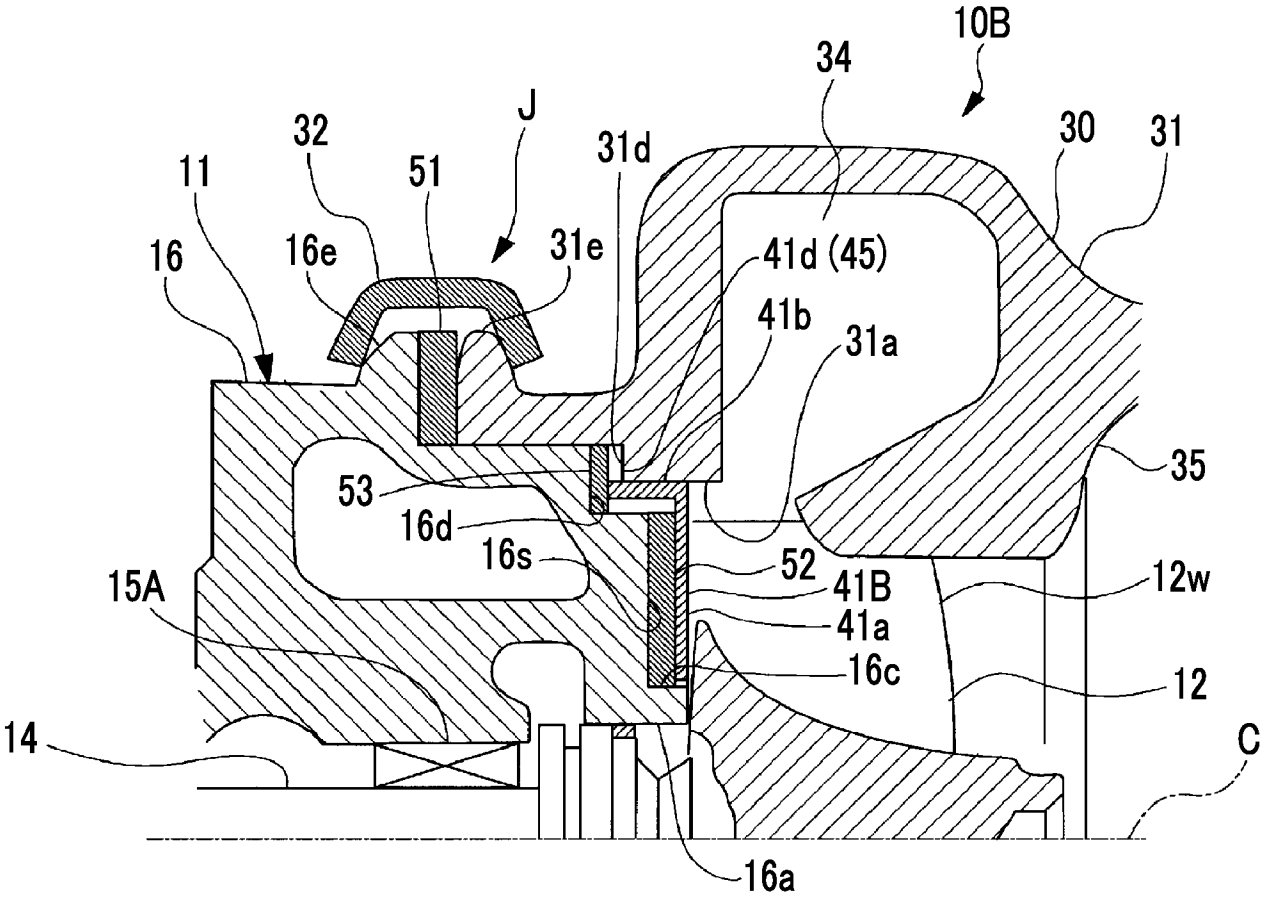
FIG. 5 is an enlarged cross-sectional view showing a configuration in the vicinity of a joint portion between a turbine housing and a bearing housing in a second embodiment of the present invention.
Figure 6:
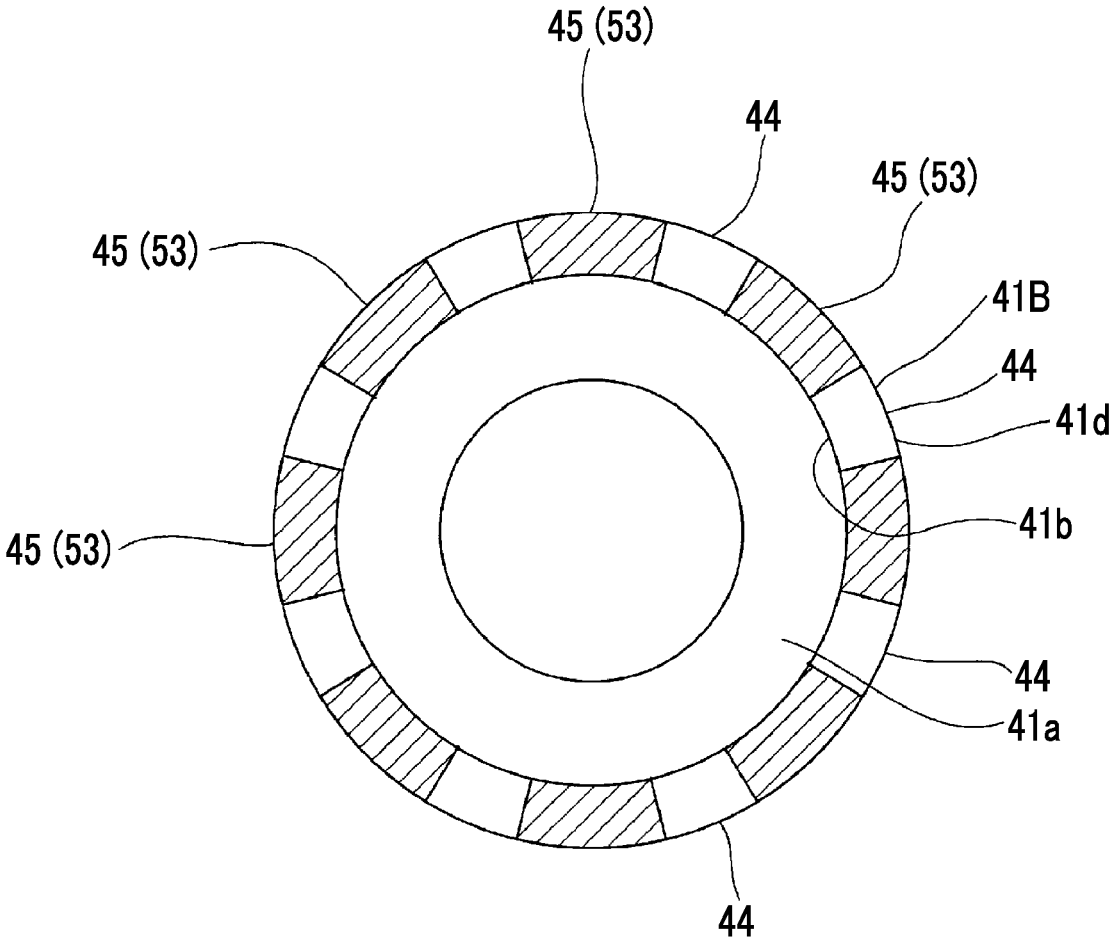
FIG. 6 is a view showing an example of a shape of a back plate in the second embodiment of the present invention.

FIG. 5 is an enlarged cross-sectional view showing a configuration in the vicinity of a joint portion between a turbine housing and a bearing housing in the second embodiment of the present invention. FIG. 6 is a view showing an example of a shape of a back plate in the second embodiment of the present invention.

As shown in FIG. 5, a turbocharger 10B of the present embodiment includes the turbocharger body 11, the compressor 20 (refer to FIG. 1), and the turbine 30.

In the joint portion J, the joint-portion heat shielding portion 51 is provided between the end portion 31*e* of the turbine housing 31 of the turbine 30 and the end portion 16*e* of the bearing housing 16 of the turbocharger body 11.

In the opening 31*a* of the turbine housing 31, a back plate 41B is provided on the bearing housing 16 side with respect to the turbine wheel 12. For example, the back plate 41B is formed of a material having heat resistance such as a stainless steel alloy or Inconel.

The back plate 41B integrally includes the plate portion 41*a*, the tubular portion 41*b*, and the flange portion (outer peripheral-side end portion) 41*d*.

As shown in FIG. 6, the flange portion 41*d* includes a plurality of flange protrusion portions 44 which are provided at intervals in a circumferential direction. Each of the flange protrusion portions 44 is formed to extend radially outward from the tubular portion 41*b*. In this way, in the back plate 41B, openings 45 are formed between the flange protrusion portions 44 adjacent to each other in the circumferential direction in the flange portion 41*d*. In FIG. 6, the plate outer peripheral heat shielding portion 53 is viewed through the openings 45.

As shown in FIG. 5, the flange portion 41*d* is disposed between a step section 31*d* which protrudes radially inward from the inner peripheral surface of the turbine housing 31 and protrudes radially inward and the end surface 16*d* which faces the step section 31*d* with a gap in the bearing housing 16.

A gap is provided between the plate portion 41*a* of the back plate 41B and the end surface 16*s* of the bearing housing 16 which faces the plate portion 41*a* with a space, and the inner peripheral heat shielding portion 52 is provided in the gap.

The plate outer peripheral heat shielding portion 53 is provided between the flange portion 41*d* of the back plate 41B and the end surface 16*d* of the bearing housing which faces the flange portion 41*d*. The above-described flange portion 41*d* and plate outer peripheral heat shielding portion 53 are interposed between the step section 31*d* of the turbine housing 31 and the end surface 16*d* of the bearing housing 16.

Here, in the flange portion 41*d* of the back plate 41B in the plate outer peripheral heat shielding portion 53, the opening 45 is adjacent to the turbine 30 side in a portion where the opening 45 is formed. For example, the opening 45 is filled with air or a material similar to that of the plate outer peripheral heat shielding portion 53, and the air or the material has thermal conductivity lower than that of the flange portion 41*d* of the back plate 41B.

Therefore, according to the turbocharger 10B of the above-described second embodiment, in addition to the plate outer peripheral heat shielding portion 53 being provided between the flange portion 41*c* of the back plate 41 and the bearing housing 16, the openings 45 are formed on the back plate 41 which is positioned on the turbine housing 31 side with respect to the plate outer peripheral heat shielding portion 53. Accordingly, the plate outer peripheral heat shielding portion 53 faces the opening 45. The thermal conductivity of the inner space in each opening 45 is lower than the thermal conductivity of the back plate 41, and thus, heat shielding effects can be obtained by the inner space of the opening 45. Accordingly, it is possible to further inhibit heat from the flange portion 41*c* of the back plate 41 from being transmitted to the bearing housing 16.

As a result, it is possible to further suppress the energy loss in the turbine 30 and the heat input from the turbine 30 to the bearing.

In the above-described second embodiment, the joint-portion heat shielding portion 51 and the inner peripheral heat shielding portion 52 are provided. However, the joint-portion heat shielding portion 51 and the inner peripheral heat shielding portion 52 are not indispensable configurations, and may be changed to other configurations, or these configurations may not be provided.

Third Embodiment

Next, a third embodiment of the present invention will be described. In the third embodiment, only a configuration having a turbine-side heat shielding portion is different from that of the first embodiment, and thus, the same reference numerals are assigned to the same portions as those of the first embodiment, and overlapping descriptions thereof are omitted.

Figure 7:
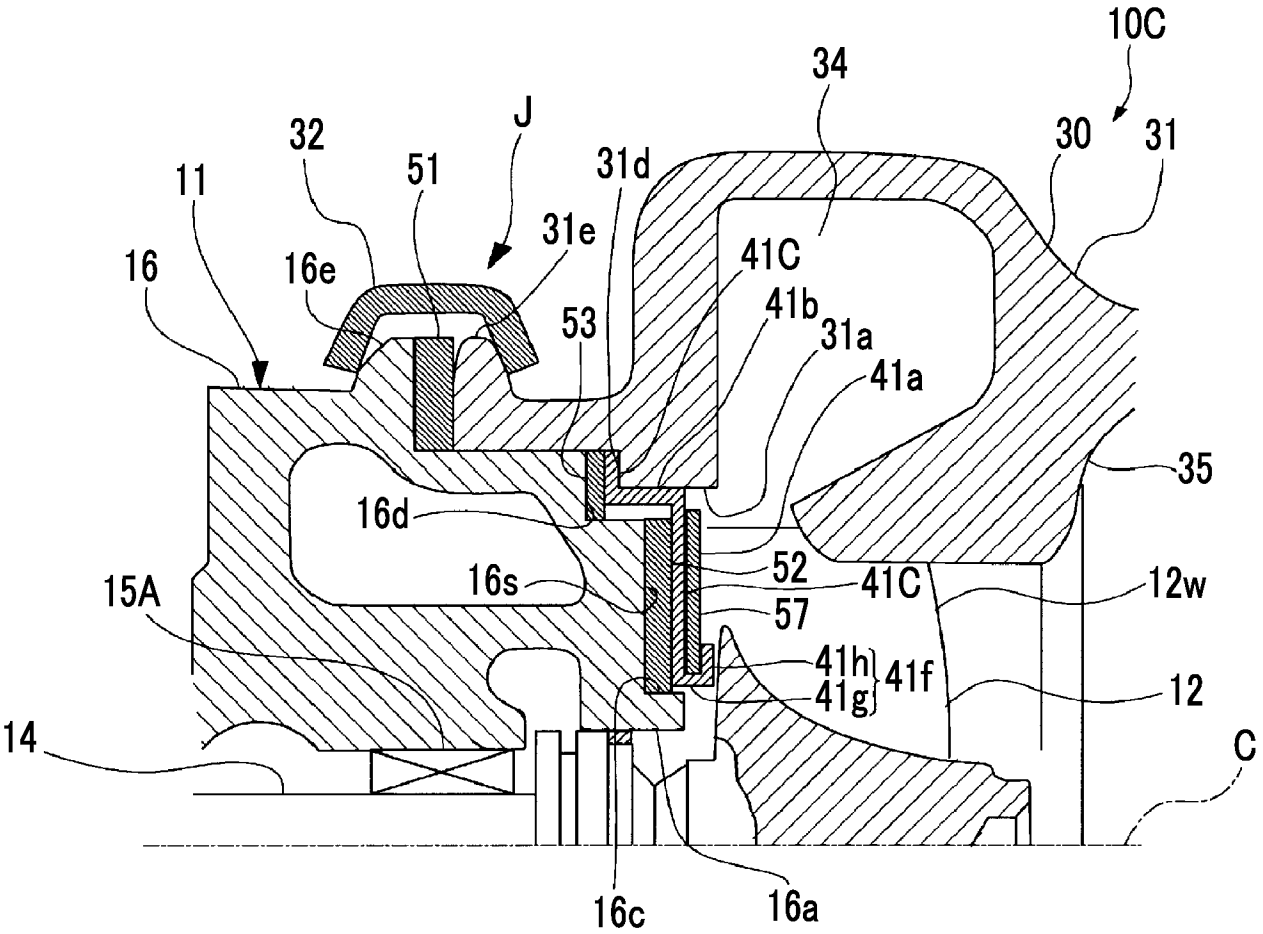
FIG. 7 is an enlarged cross-sectional view showing a configuration in the vicinity of a joint portion between a turbine housing and a bearing housing in a third embodiment of the present invention.

FIG. 7 is an enlarged cross-sectional view showing a configuration in the vicinity of a joint portion between a turbine housing and a bearing housing in the third embodiment of the present invention.

As shown in FIG. 7, a turbocharger 100 of the present embodiment includes the turbocharger body 11, the compressor 20, and the turbine 30 (refer to FIG. 1).

The joint-portion heat shielding portion 51 is provided between the end portion 31*e* of the turbine housing 31 of the turbine 30 and the end portion 16*e* of the bearing housing 16 of the turbocharger body 11.

The joint-portion heat shielding portion 51 is formed of a material having thermal conductivity lower than that of the turbine housing 31. For example, the joint-portion heat shielding portion 51 can be formed of a heat insulating material or a heat shielding material having the thermal conductivity of 0.1 W/m/K or less at the room temperature. For example, the joint-portion heat shielding portion 51 can be formed of a porous body or sheet material made of a ceramic material, a silica material, or the like. In the joint-portion heat shielding portion 51, a coating may be applied to at least one of the end portion 31*e* of the turbine housing 31 and the end portion 16*e* of the bearing housing 16 facing each other with the heat shielding material having the thermal conductivity.

Here, the joint-portion heat shielding portion 51 has strength to maintain a predetermined thickness in a state of being interposed between the end portion 31*e* of the turbine housing 31 and the end portion 16*e* of the bearing housing 16.

In the opening 31*a* of the turbine housing 31, a back plate 41C is provided on the bearing housing 16 side with respect to the turbine wheel 12. For example, the back plate 41 is formed of a material having heat resistance such as a stainless steel alloy or Inconel.

The back plate 41C integrally includes the plate portion 41*a*, the tubular portion 41*b*, and the flange portion 41*c*, and the heat shielding material holding portion 41*f*.

The plate portion 41*a* closes a portion between the outer peripheral surface of the boss section 16*c* protruding toward the turbine 30 side on one end side of the bearing housing 16 and the opening 31*a*.

The tubular portion 41*b* is formed in a tubular shape to extend from the outer peripheral portion of the plate portion 41*a* to the bearing housing 16 side along the inner peripheral surface of the opening 31*a*.

The flange portion 41*c* is formed to extend radially outward from an end portion of the tubular portion 41*b* on the bearing housing 16 side. The flange portion 41*c* is interposed between the step section 31*d* which is formed on the inner peripheral surface of the turbine housing 31 and protrudes radially inward and the end surface 16*d* which faces the step section 31*d* with a gap in the bearing housing 16.

The heat shielding material holding portion 41*f* integrally includes a tubular support portion 41*g* which extends from an inner peripheral edge portion of the plate portion 41*a* to the turbine 30 side and a support plate portion 41*h* which extends radially outward from a tip end portion of the tubular support portion 41*g* on the turbine 30 side.

A gap is provided between the plate portion 41*a* of the back plate 41C and the end surface 16*s* of the bearing housing 16 which faces the plate portion 41*a* with a gap, and the inner peripheral heat shielding portion 52 is provided in the gap.

In addition, the plate outer peripheral heat shielding portion 53 is provided between the flange portion 41*c* of the back plate 41C and the end surface 16*d* of the bearing housing 16 which faces the flange portion 41*c*.

A turbine-side heat shielding portion 57 is held by the heat shielding material holding portion 41*f* of the back plate 41C on the turbine 30 side of the back plate 41C.

The turbine-side heat shielding portion 57 is formed in an annular shape and is provided to cover the plate portion 41*a* radially outside the tubular support portion 41*g*. A portion on the inner peripheral side of the turbine-side heat shielding portion 57 is covered with the support plate portion 41*h*.

The inner peripheral heat shielding portion 52, the plate outer peripheral heat shielding portion 53, and the turbine-side heat shielding portion 57 are formed of a material having thermal conductivity lower than those of the turbine housing 31 and the back plate 41C. For example, preferably, the inner peripheral heat shielding portion 52, the plate outer peripheral heat shielding portion 53, and the turbine-side heat shielding portion 57 are formed of a heat insulating material or a heat shielding material having the thermal conductivity of 0.1 W/m/K or less at the room temperature. For example, the heat insulating material or the heat shielding material can be formed of a porous body, a sheet material, or the like made of a ceramic material, a silica material, or the like.

The inner peripheral heat shielding portion 52, the plate outer peripheral heat shielding portion 53, and the turbine-side heat shielding portion 57 may be formed by applying coating with the heat shielding material having the thermal conductivity. Moreover, the inner peripheral heat shielding portion 52, the plate outer peripheral heat shielding portion 53, and the turbine-side heat shielding portion 57 are not required to have strength. Accordingly, for example, fibers made of a heat insulating material or a heat shielding material may be used to be formed in a sponge shape as long as it has required heat resistance. In addition, the inner peripheral heat shielding portion 52 and the plate outer peripheral heat shielding portion may be formed such that only a portion between the flange portion 41*c* of the back plate 41C and the end surface 16*d* of the bearing housing 16 facing the flange portion 41*c* is filled with air.

Therefore, according to the turbocharger 10C of the above-described third embodiment, the turbine-side heat shielding portion 57 is provided between the back plate 41 and the turbine wheel 12, and thus, it is possible to inhibit a temperature of the back plate 41 from increasing due to heat on the turbine 30 side. Accordingly, it is possible to inhibit heat from being transmitted from the turbine housing 31 side to the bearing housing 16 via the back plate 41.

As a result, it is possible to further suppress the energy loss in the turbine 30 and the heat input from the turbine 30 to the bearing.

Modification Example of Third Embodiment

In the above-described second embodiment, the turbine-side heat shielding portion 57 is held by the heat shielding material holding portion 41*f* of the back plate 41C. However, the present invention is not limited to this.

Figure 8:
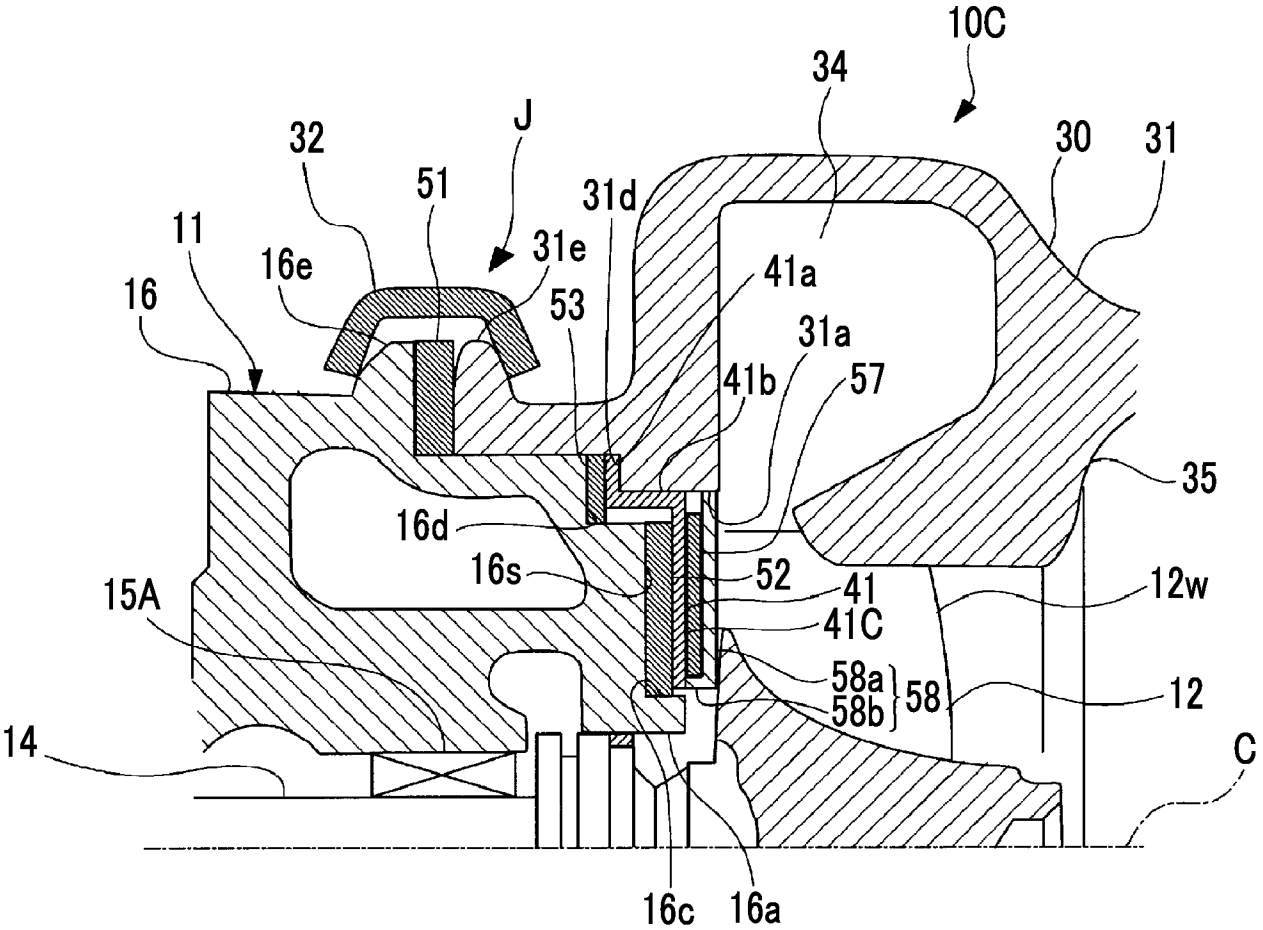
FIG. 8 is an enlarged cross-sectional view showing a configuration in the vicinity of a joint portion between a turbine housing and a bearing housing in a modification example of the third embodiment of the present invention.

FIG. 8 is an enlarged cross-sectional view showing a configuration in the vicinity of a joint portion between a turbine housing and a bearing housing in a modification example of the third embodiment of the present invention.

As shown in FIG. 8, in the turbine housing 31, the back plate 41 and a heat shielding member cover portion 58 are provided on the turbine 30 side with respect to the turbine-side heat shielding portion 57 provided on the turbine 30 side with respect to the back plate 41.

The heat shielding member cover portion 58 integrally includes a cover plate (partition member) 58*a* which extends radially inward from the opening 31*a* of the turbine housing 31 and a heat shielding member holding portion 58*b* which extends from an inner peripheral edge portion of the cover plate 58*a* to the bearing housing 16 side.

The turbine-side heat shielding portion 57 on the turbine 30 side is covered with the cover plate 58*a*.

In the above-described configuration, in the turbine-side heat shielding portion 57, it is possible to suppress heat transmitted from the turbine wheel 12 side to the turbine-side heat shielding portion 57 by the cover plate 58*a* which is provided on the turbine wheel 12 side with a gap with respect to the plate portion 41*a* of the back plate 41. Accordingly, it is possible to further suppress the energy loss in the turbine 30 and the heat input from the turbine 30 to the bearing.

Similarly to the cover plate 58*a*, the support plate portion 41*h* of the heat shielding material holding portion 41*f* in the above-described third embodiment may be formed so as to cover the entirety of the turbine-side heat shielding portion 57.

In addition, the joint-portion heat shielding portion 51 and the plate outer peripheral heat shielding portion 53 are provided. However, the joint-portion heat shielding portion 51 and the plate outer peripheral heat shielding portion 53 are not indispensable configurations, and may be changed to other configurations, or these configurations may not be provided.

Other Modification Examples

The present invention is not limited to the above-described embodiments, and includes various modifications to the above-described embodiments within the scope which does not depart from the gist of the present invention. That is, the specific shapes, configurations, or the like described in the embodiments are merely examples, and can be appropriately changed.

For example, the shape or the like of the back plate 41 is not limited, and other shapes such as a flat plate shape without having the tubular portion 41*b* may be adopted.

In addition, the configuration of each portion such as the turbocharger body 11, the compressor 20, the turbine 30, or the like of the turbocharger 10A is not limited to those exemplified above, and may be changed to other configurations.

INDUSTRIAL APPLICABILITY

The present invention can be applied to the turbocharger. According to this invention, it is possible to suppress the energy loss in the turbine and the heat input from the turbine to the bearing.

REFERENCE SIGNS LIST

10A, 10B, 10C: turbocharger
11: turbocharger body
12: turbine wheel
12*w*: turbine blade
13: compressor wheel
14: rotating shaft
14*a*: first end portion
14*b*: second end portion
15A, 15B: bearing
16: bearing housing
16*a*, 16*b*: opening
16*c*: boss section
16*d*: end surface
16*e*: end portion
16*s*: end surface
20: compressor
30: turbine
31: turbine housing
31*a*: opening
31*d*: step section
31*e*: end portion
32: connection fitting
34: scroll flow path
35: exhaust section
41, 41B, 41C: back plate
41*a*: plate portion
41*b*: tubular portion
41*c*, 41*d*: flange portion (outer peripheral-side end portion)
41*f*: heat shielding material holding portion
41*g*: tubular support portion
41*h*: support plate portion
44: flange protrusion portion
45: opening
51: joint-portion heat shielding portion
52: inner peripheral heat shielding portion
53: plate outer peripheral heat shielding portion
55: spacer
55*k*: cut-out portion (heat shielding portion holder)
55*r*: annular portion
55*t*: protrusion portion
55*t*, 55*t*: protrusion portion
57: turbine-side heat shielding portion
58: heat shielding member cover portion
58*a*: cover plate (partition member)
58*b*: heat shielding member holding portion
C: central axis (axis)

The invention claimed is:

1. A turbocharger comprising:

a rotating shaft which extends along an axis;

a turbine wheel which is provided on a first end portion side of the rotating shaft;

a compressor wheel which is provided on a second end portion side of the rotating shaft;

a bearing housing which rotatably supports the rotating shaft;

a turbine housing which covers the turbine wheel;

a back plate which includes a plate portion which is provided between the bearing housing and the turbine wheel and an outer peripheral end portion which is formed radially outside the plate portion and is supported to be interposed between the bearing housing and the turbine housing;

a plate outer peripheral heat shielding portion which is provided between the outer peripheral end portion of the back plate and an end surface of the bearing housing which faces the outer peripheral end portion; and an inner peripheral heat shielding portion which is placed with in a gap between the plate portion of the back plate and an end surface of the bearing housing;

wherein the inner peripheral heat shielding portion and the plate outer peripheral heat shielding portion are formed of a material having thermal conductivity lower than that of the turbine housing and the back plate, wherein the inner peripheral heat shielding portion is configured to fill the gap between the back plate and the bearing housing, and wherein the turbocharger further comprising:

a spacer which is interposed between the bearing housing and the turbine housing, wherein the spacer includes a plurality of cut-out portions which is formed at intervals in a circumferential direction, and each of the plurality of cut-out portions holds the plate outer peripheral heat shielding portion, and wherein a plurality of openings are formed on the outer peripheral end portion of the back plate at intervals in a circumferential direction.

* * * * *